United States Patent [19]

Stenzel et al.

[11] Patent Number: 4,993,690

[45] Date of Patent: Feb. 19, 1991

[54] ELECTROSLAG REMELTING PLANT INCLUDING AN INGOT MOLD AND A HOOD

[75] Inventors: Otto Stenzel, Grundau; Wolfram Diemar, Clausthal; Heiko Spengemann, Langenselbold; Heinz Kohnert, Erlensee; Leo Emiljanow, Maintal; Helmut Gröf, Bruchköbel, all of Fed. Rep. of Germany

[73] Assignee: Leybold Aktiengesellschaft, Hanau, Fed. Rep. of Germany

[21] Appl. No.: 391,182

[22] Filed: Aug. 9, 1989

[30] Foreign Application Priority Data

Jan. 1, 1989 [DE] Fed. Rep. of Germany ..... 3901297

[51] Int. Cl.[5] ..... C21B 7/22; C22B 4/00; H05B 3/60

[52] U.S. Cl. ..... 266/158; 75/10.24; 373/42; 373/44

[58] Field of Search ..... 75/10.24; 266/158; 373/42, 44

[56] References Cited

U.S. PATENT DOCUMENTS 3,729,307 4/1973 Plessing ..... 75/10.24

3,738,825 6/1973 Medovar ..... 75/10.24

*Primary Examiner*—Peter D. Rosenberg

*Attorney, Agent, or Firm*—Felfe & Lynch

[57] ABSTRACT

An electroslag remelting plant includes an ingot mold 4 for forming a block from remolten material, at least one consumable electrode 26, a body having at least one vertically driven electrode rod 20 for the advance of the consumable electrode and a hood 33 disposed above the ingot mold which has at least one concentric opening toward the respective electrode axis. In order to limit the volume over the slag the following is provided: The hood 33 is, with respect to its vertical axis "A", subdivided into laterally movable sectors 34, 35 each of which is, at a first sealing joint 41, gas-tight connected with its lower edge 40 to top of the ingot mold 4 as far as possible and with its upper edge 39, at a second sealing joint 42, gas-tight sealed as far as possible with respect to the electrode rod. Further, the hood 33 has an interior of such cross section and height that, in its most elevated position, the top end of the at least one consumable electrode 26 is below the second sealing joint 42 of the hood 33.

14 Claims, 6 Drawing Sheets

ELECTROSLAG REMELTING PLANT INCLUDING AN INGOT MOLD AND A HOOD

BACKGROUND OF THE INVENTION

The invention relates to an electroslag remelting plant including an ingot mold for forming a block from the material of at least one consumable electrode, including a rack having at least one vertically driven electrode rod for the advance of at least one consumable electrode and including a hood disposed above of the ingot mold which has at least one concentric aperture toward the respective electrode axis.

Such a remelting plant is known from the German DE-AS No. 20 31 708, to which U.S. Pat. No. 3,729,307 corresponds. The hood described therein is used to reduce the radiation loss and for this purpose it is coated with mineral heat insulator. In this achievement of the object it is not the electrode rod but the electrode itself which passed through the hood. Since consumable electrodes of this kind commonly have an irregularly formed surface it is necessary that the aperture in the hood be correspondingly large in dimension. Since the hood is placed onto the top edge of the ingot mold, insulated spacers are inserted so as to avoid a short-circuit; this causes a chimney effect, i.e. surrounding air is sucked in through the gap at the bottom to escape again through the annular gap between the hood and the electrode. This gas circulation leads to significant problems which will be dealt with hereinafter.

In the remelting process the molten slag, which is at a high temperature, assumes in a way the function of a heating resistor. The metal of the consumable electrode immersing into the liquid slag is passed through the slag in the form of drops and gathers underneath to form a melt which solidifies at its lowest phase interface into a block or ingot. The heat removal necessary for the solidification is usually carried out by means of a cooling agent (water) flowing through the ingot mold unit. The slag which can have different compositions depending on the impurities to be removed and the metals used is essential to metallurgic purification process. Slag compositions are known in great numbers.

The remelting process described produces gases which not escape into the atmosphere but must be exhausted. In several cases it is also advantageous to pass an oxygen-containing gas over the slag to burn a part of the sulfur which is gathering in the liquid melt. On the other hand, during this process moisture from the surrounding air must be avoided from entering in the melt to be reduced to hydrogen. The hydrogen would be absorbed by the forming block.

In order to also eliminate the effects of atmospheric moisture known hoods were provided with a dry air supply which, however, met the requirements in a less than satisfactory way. In this process large amounts of dry air are required which, in turn, involves high investments costs for the plant to generate this dry air. Since this process also involves large amounts of waste air this calls for additional investment costs for the necessary exhaust gas purification systems.

Initial experiments with electroslag remelting processes included attempts in vacuum arc furnaces which by manufacture can be hermetically closed. However, the vacuum-tight design of these furnaces extremely expensive and labor-intensive, moreover, the bell-shaped upper parts of these furnaces hamper the process control. However, the vacuum-tight design of these furnaces involves an extremely high amount of labor and cost and, moreover, the bell-like upper part of these furnaces hampers process operation. Complicated lifting devices must hence be provided for the charging of such furnaces which again tremendously increases the overall investment costs for such remelting plants. Hence, electroslag remelting in vacuum arc furnaces did not prevail on the market for large-scale industrial use.

SUMMARY OF THE INVENTION

It is hence an object of the invention to provide an electroslag remelting plant of the aforesaid kind in which no gases escape into the environment in an uncontrolled way and wherein no large amounts of gases are required for a desired gas supply (for example dry air) and which still do not hamper process operation.

The object is achieved in the aforesaid electroslag remelting plant in that the hood is divided into two segments which are movable transversely to the axis of the electrode rod. The segments are closable to form a first sealing joint about the ingot mold and a second sealing joint about the electrode rod. The hood has an interior of such cross-section and height that the consumable electrode is, in its most elevated position, below the second sealing joint.

Subdividing the hood in segments which can be laterally moved, for example, swung out or telescope-like extended permits the necessary access to the system during preparation phase, especially the insertion and/or recharging of individual electrodes as well as slag. As compared to vacuum arc furnaces, this accessibility is achieved without complex lifting mechanisms for the lifting and lateral swing-out. However, it must be taken into account that in the case of vacuum arc furnaces the furnace rod, which is passed gas-tight through the upper part of the furnace, must also be swung out such that the entire driving mechanism, power supply, etc. must necessarily be equipped with the corresponding degrees of freedom. This vertical and transverse mobility of the upper part of furnaces in vacuum arc furnaces leads to additional complex construction of the furnace body. By subdividing the hood into segments in accordance with the invention, the entire construction and the volume of the electroslag remelting plant are significantly reduced.

By sealing all segments with respect to the top edge of the ingot mold (first sealing joint) as well as the to the electrode rod (second sealing joint) it is ensured that the entire hood is sealed sufficiently gas-tight such that only small amounts of gas must be supplied and removed (e.g. dry air or inert gas). Hence, the systems for air conditioning and dry air generation as well as exhaust gas purification can be made much smaller in size. Remelting under inert gas drastically reduces the consumption of expensive inert gas which, in turn, increases the number of alloys which can be economically remelted by means of electroslag remelting. By also totally excluding atmospheric humidity the final block contains no hydrogen which could drastically degrade the metallurgic qualities of such a block or cause long annealing times.

The hood in accordance with the invention also permits supplying reactive gases such as oxygen in certain doses to the space above the slag and, hence, to the slag itself so as to oxidize the sulfur contained in the slag.

Providing the interior of the hood with such a cross section and such a height that the top end of at least one consumable electrode in its most elevated position is below the second sealing joint of the hood permits a sufficient degree of freedom for the up and down movement of the electrode during the remelting process. This feature, too, distinguishes the invention from known hoods having a ceramic lining and wherein the consumable electrode is passed through the hood via an annular gap which is provided. Sealing the hood with respect to the electrode rod, however, does not cause problems.

Preferably, the number of segments corresponds to the number of electrode rods or consumable electrodes which are simultaneously used in the process.

In electroslag remelting plant with only one electrode rod it is hence particularly advantageous that the hood includes two semi-cylindrical or half-cup like segments having vertical separation joints and be suspended at a vertical articulated axle where they can be moved and, furthermore, when it is provided with semicircular sealing surfaces at its top and bottom edges in the area of its first and second sealing joint and when it is provided with linear sealing edges at the separation joints so as to form third and fourth sealing joints.

In order to protect the sealing joints or sealing edges against thermal radiation of the slag they are preferably disposed such that there is no visual contact with the slag.

Preferably, feed lines for dry air and/or reactive gases, charging devices for slag and/or alloy elements can be disposed in the individual segments.

It is particularly advantageous when the electrode rod is surrounded by a stationary, radially extending, annular-disk-like top wall which on the one side is sealed with respect to the electrode rod and on the other side with respect to the segments of the hood thus forming the top closing of the hood.

Preferably, this top wall is provided with a device for monitoring the melting process as well as the charging procedures. Further, it can be provided with a suction channel connected to a gas purification system and a suction pump.

A further particularly advantageous embodiment of the invention determines that the hood is also used for power supply such that special conductive bars can be omitted which could hamper the accessibility of the remelting plant although they are only quasi-coaxial, i.e. disposed in pairs on diametrically opposed sides of the electrode and the electrode rod.

The hood is advantageously used for power supply to the ingot mold in that the hood is provided with a first supply point at its top side and at least a second power contact device at its bottom side so as to transmit the melting current to a counter contact device at the ingot mold.

An absolutely coaxial current path to the electrode and the electrode rod is thus created.

In a configuration including two half-cup like sectors and a top top wall the arrangement is particularly advantageous in that the first power supply point is disposed at the top wall and that current contact devices are disposed between the top wall and the top edge of the sectors. A closing movement of the half-cup like sectors thus permits simultaneous contacting in the top and bottom area of the hood.

Additional advantageous embodiments of the invention can be gathered from the subclaims. The description of additional advantageous can be gathered from the subsequent description of details.

The hood to be used with remelting plants including a so-called stationary ingot mold as well as such plants including a sliding ingot mold. In the first case a block is formed stationary in the stationary ingot mold; in the last case the block is downwardly withdrawn from the (significantly shorter) ingot mold in proportion to the speed of solidification.

DETAILED DESCRIPTION OF THE PREFERRED EMBODIMENT

Figure 1:
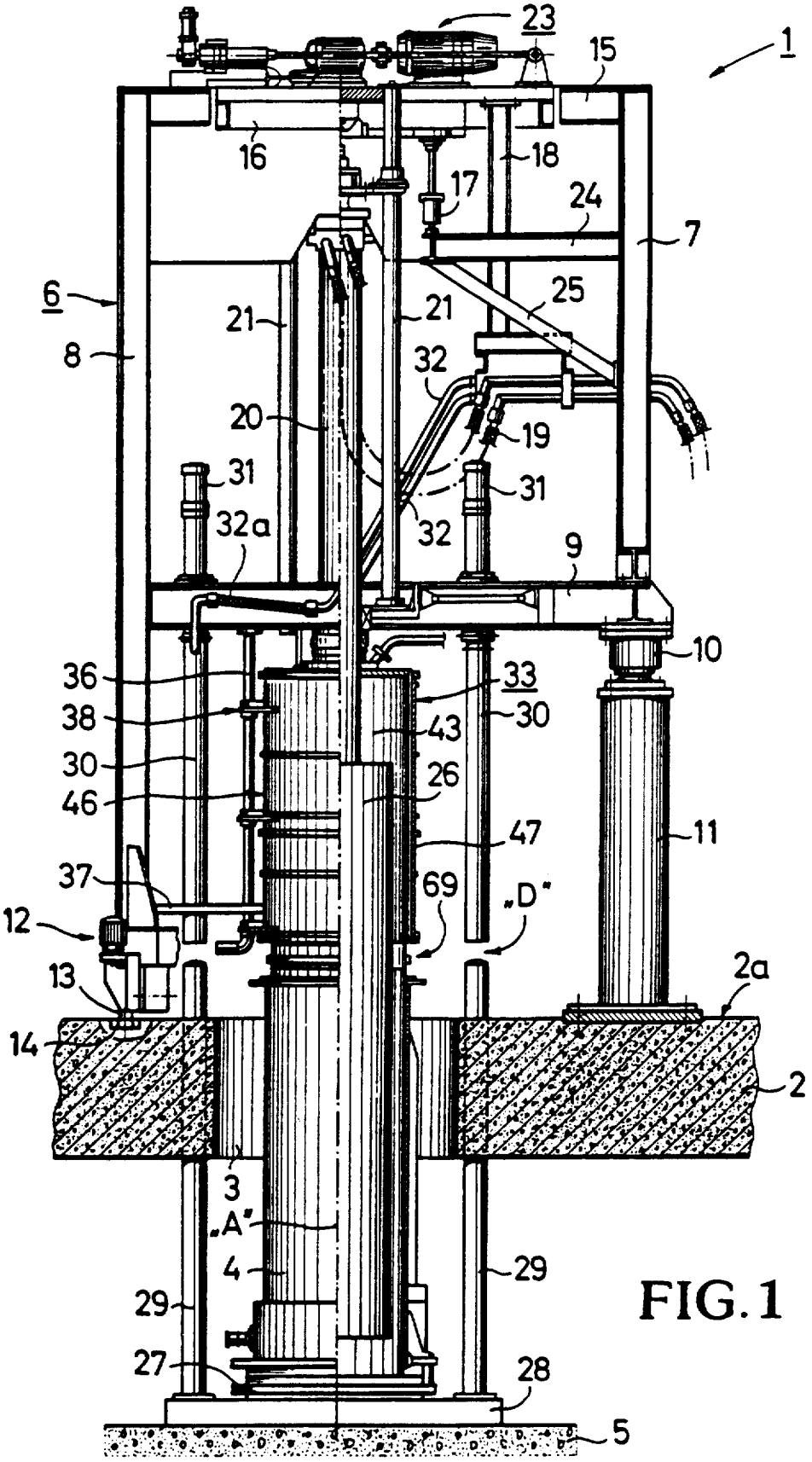
FIG. 1 is a fragmentary, lateral section view of a complete electroslag remelting plant including two current bars disposed diametrically with respect to the electrode axis.

FIG. 1 illustrates an electroslag remelting plant 1 placed on the floor 2. An ingot mold extends through a hole 3 in the floor into a pit of which only the bottom 5 is represented. The ingot mold 4 is a conventional, water-cooled stationary ingot mold. The furnace body 6 including several vertical columns 7 and 8, two of which can be seen in FIG. 1, extends over the floor. Column 7 is shorter in length and rests, supported by a platform and a pivot bearing 10, on a stationary column 11 which is fixed to the floor. The pivot bearing 10 defines a vertical rotational axis for the furnace body 6 the columns of which are provided with a driving mechanism 12 facing away from the rotational axis and parallel to it. This driving mechanism drives a roll 13, which rolls on a circular rail 14 on the floor.

In addition to the lower platform 9, the furnace body has a upper platform 15 such that in a lateral view, the furnace body assumes the shape of an "A." The upper platform 15 is configured as a frame on which a measuring platform 16 rests, supported by several weight measuring caps 17. Via a support 18 the cables 19 to supply power to the electrode rods 20 are also suspended at the measuring platform 16 as is a sliding seal 22 via support 21; through this seal the electrode rod 20 is passed through gas-tight. For further details refer to FIG. 4.

This arrangement was made so as to compensate different cable weight percentages and frictional forces which occur in case of a longitudinal dislocation of the electrode rod 20 with respect to the sliding seal 22 such that they do not affect the weight measuring caps 17. A vertically movable electrode rod 20 is also suspended at the measuring platform 16 and a driving assembly 23 for moving the electrode rod is disposed thereon. Since the frictional forces occurring at the sliding seal necessarily also occur at the electrode rod 20 the effects thereof mutually neutralize at the measuring platform 16. Extending arms 24 mounted to the columns 7 and 8 and supported by diagonal struts 25 serve as counterbearings for the weight measuring caps 17. The transmission elements between driving assembly 23 and electrode rod 20 are prior art and, hence, not explained in further detail. As commonly known, measuring the weight of the electrode serves to control the melting parameters, especially to control the electrode advance.

A consumable electrode 26 having its original length in the position as illustrated is coaxially mounted to the electrode 20. A significant part of its length extends into the ingot mold 4 and ends with its lower front side shortly above the bottom of the ingot mold 27 which, in turn, rests on a bottom plate 28.

On both sides and diametrically opposed to the common axis A of the ingot mold 4, the consumable electrode 26 and the electrode rod 20 there are two busbars 29 parallel to the axis which define current paths quasi-coaxial with respect to the ingot mold 4. These busbars are passed through the floor 2 and end shortly above the surface 2*a*. In a coaxial and aligned relationship thereto two busbars 30 are vertically and movably disposed in the lower platform 9; they can be controlled by lifting actuators 31. In FIG. 1 the top busbars 30 are represented in an elevated position such that the connection to the bottom busbars 29 is interrupted. Lowering the top busbars eliminates the distance D, i.e. the busbars 29 and 30 form continuous, quasi-coaxial current paths for recirculation of the melting current. The positive effects of a coaxial and quasi-coaxial current conduction are known and, hence, they need not be dealt with in further detail hereinafter. Connecting lines 32 having flexible cable segments 32*a* lead to the top busbars 30. The possibility to interrupt between the two busbars 29 and 30 serves to move the furnace body 6 around the axis of the pivot bearing 10.

Figure 2:
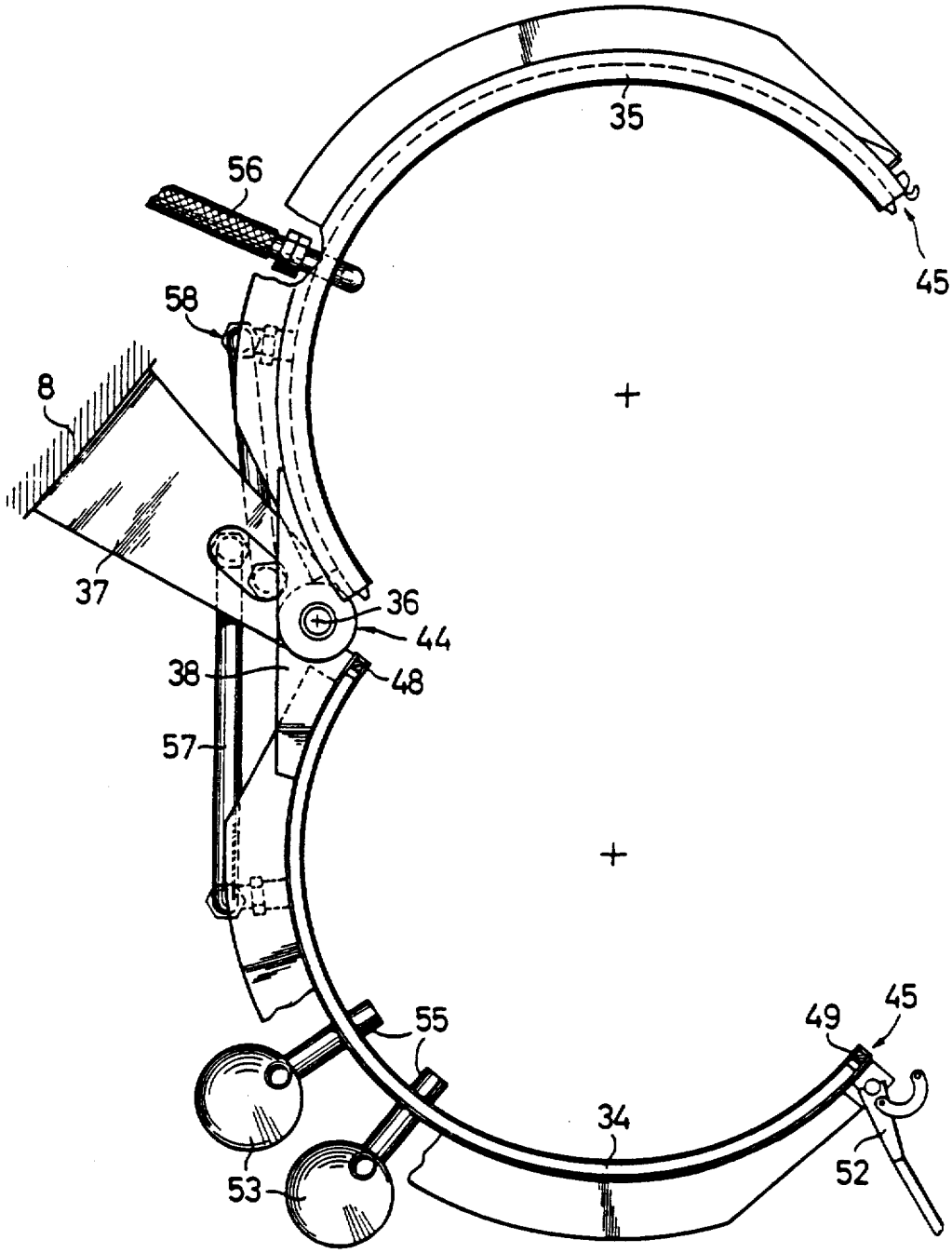
FIG. 2 is an enlarged top view onto the two opened half-cup like sector of the remelting plant according to FIG. 1.
Figure 3:
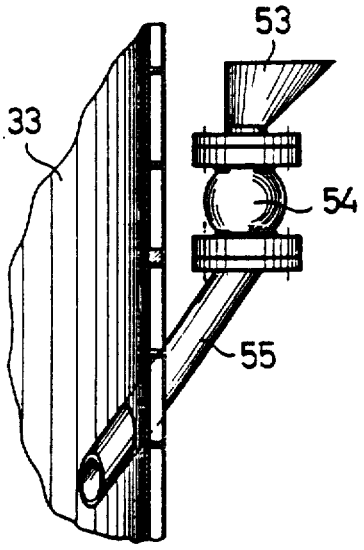
FIG. 3 is a portion of a sector of the hood including an inserted charging device.

The subject-matter of the actual invention is explained as follows:

Above the ingot mold 4 there is a hood 33 which, according to FIG. 2, includes two half-cup-like segments 34 and 35 which, in turn, are mirror-symmetrically mounted at a common vertical articulated axis 36. In FIG. 1 this articulated axis extends between the lower platform 9 and an extending arm 37 which is mounted to the column 8. The half-cup-like segments 34 and 35 are connected to the articulated axis 36 via joint plates 38. When the segments 34 and 35 are closed the axis of the hood 33 conforms with the axis "A" which prescribes the eccentricity of the articulated axis 36.

Figure 4:
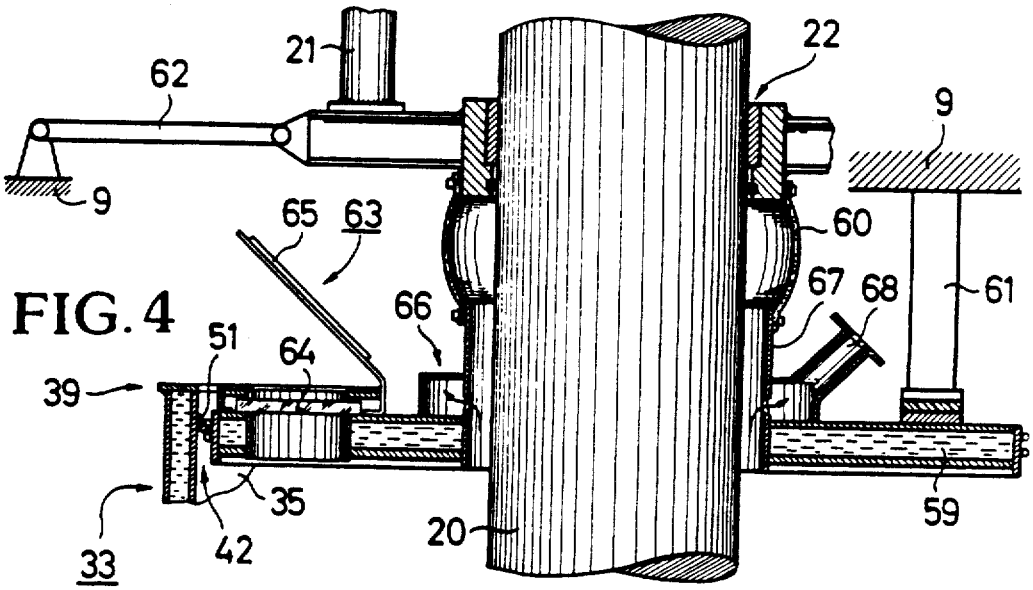
FIG. 4 is an enlarged, partial vertical section through the remelting plant according to FIG. 1 in the area of the front wall of the hood FIG. 5 ia an enlarged, partial vertical section of the remelting plant according to FIG. 1 in the area where hood, ingot mold, and ingot mold element are joint.
Figure 5:
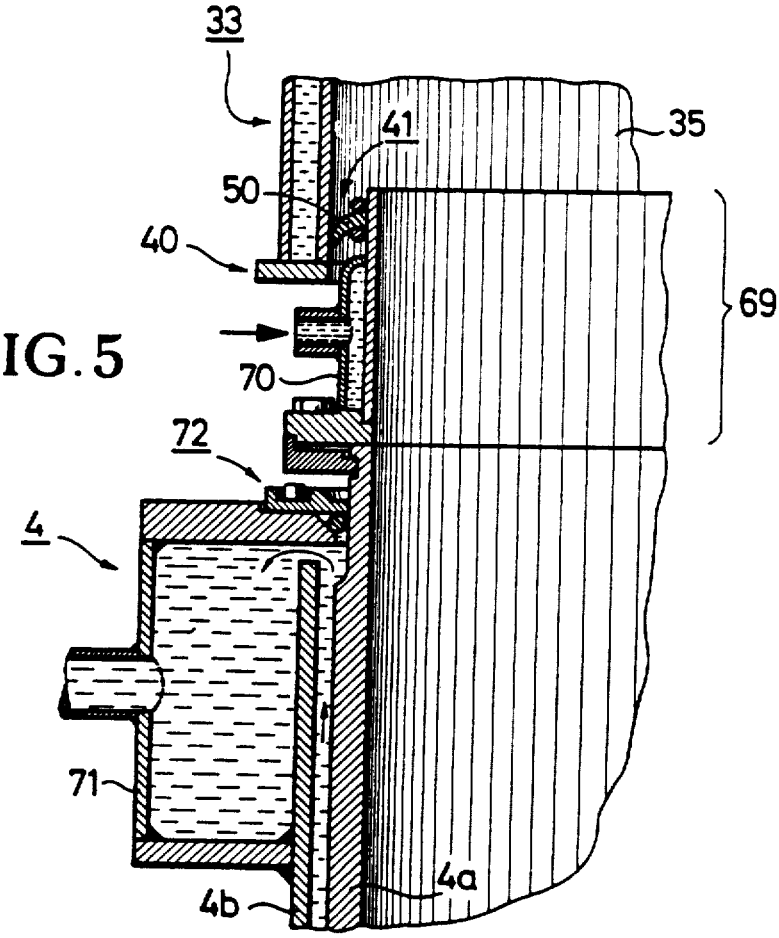

The segments 34 and 35 are configured such that they are double-walled, water-cooled and have one upper edge 39, respectively, represented in FIG. 4 and one lower edge 40, respectively, represented in FIG. 5. The lower edge functions as a first sealing joint 41 whereas the upper edge forms a second sealing edge. The arrangement is made such that the hood is subdivided, with respect to its lateral axis "A," into the laterally movable segments 34 and 35; at the first sealing joint the lower edge 40 of each of these segments is connected, indirectly and gas-tight as far as possible, to the upper part of the ingot mold 4; at the second sealing joint 42 the upper edge 39 is, also indirectly and gas-tight as far as possible, sealed with respect to the electrode rod 20.

As it can also be seen from FIG. 1, the hood has an interior 43 of such cross section and height that the top end of the consumable electrode 26 is, in its most elevated position, below the second sealing joint 42 of the hood 33. This design regulation leads to a corresponding height of the hood 33 permitting the necessary maneuverability of the electrode 26.

As it can be gathered from FIG. 2 the two half-cup-like segments 34 and 35 enclose vertical separating grooves 44 and 45 parallel to the axis and forming third and fourth sealing joints. Furthermore, at their upper and lower edges in the area of the first and second sealing joints 41 and 42, the segments form semicircular sealing surfaces which run in a plane radial to the axis "A;" at their separating grooves they have linear sealing edges 48 and 49 made of an elastomeric material and protected against a visual contact with the incandescent slag by incorporating in a recess. Additional elastomeric seals 50 and 51 are disposed at the first and second sealing joint 41 and 42. Moreover, on the side facing away from the articulated axis 36, the sectors 34 and 35 are provided with fastening devices 52 which permit an almost gas-tight closing by bracing such that a cylindrical cup is formed.

As it can also be seen from FIG. 2 the first segment 34 is provided with two charging funnels 53 which end via a charging sluice 54 and a pipe piece 55 into the interior of the hood 33. A gas line 56 for the supply of rinsing, protective and/or reactive gas ends into the other sector 56. Fig. also shows lines 57 and 58 for the cooling agent which lead to sectors 34 and 35.

The top end of the hood is configured as follows:

According to FIG. 4 the electrode rod 20 is concentrically surrounded by a annular-disk-like top wall 59 which is also double-walled and passed through by cooling water. This front wall is on one hand sealed with respect to the electrode rod 20 and on the other hand with respect to the segments 34 and 35. For this purpose, the electrode 20 is movably passed through the already described sliding ring 22 which is connected gas-tight to the front wall 59 via an intermediate link 60. The elastic intermediate link is, for example, a part made of gas-tight impregnated canvas or is a part of an elastomeric tube. Both exhibit electrically insulating properties. The front wall is suspended at the lower platform 9 by means of links 61 and the sliding seal 22 is connected to the lower platform 9 via the horizontal guide bar 62 (FIG. 4). Further, the top wall 59 has at least one monitoring device 63 which includes a viewing window 64 and a deflecting mirror 65 such that in a way a reverse periscope is formed for visually monitoring the melting process.

Furthermore, a suction channel 66 which communicates via holes with a pipe piece 67 concentrically surrounding the electrode rod 20 is disposed on the top wall 59. The exhaust gases are removed via suction channel 66 and a suction piece 68 and fed to a non-represented gas reprocessing device. At its top end the pipe piece 67 also supports the elastic intermediate link 60. The hood 33 is in this way supplied with a defined gaseous atmosphere and the exhaust gases having impurities and/or reaction products can be removed in a simple way.

As it can be gathered from FIG. 5 a tubular top 69 surrounded by a cooling channel 70 is attached to the ingot mold by means of screws. Above this cooling channel an elastomeric annular seal 50 is attached to the ingot mold top 69. In the present case the interior surfaces of the ingot mold 4 and the ingot mold top 69 are on one cylindrical surface. At its top end on the external side the ingot mold 4 has a hollow-cylindrical collecting channel 72 for the cooling agent (water). Gland bolts 72 permit a different longitudinal extensions between interior wall 4*a* and exterior wall 4*b* of the double-walled ingot mold arrangement 4.

Figure 8:
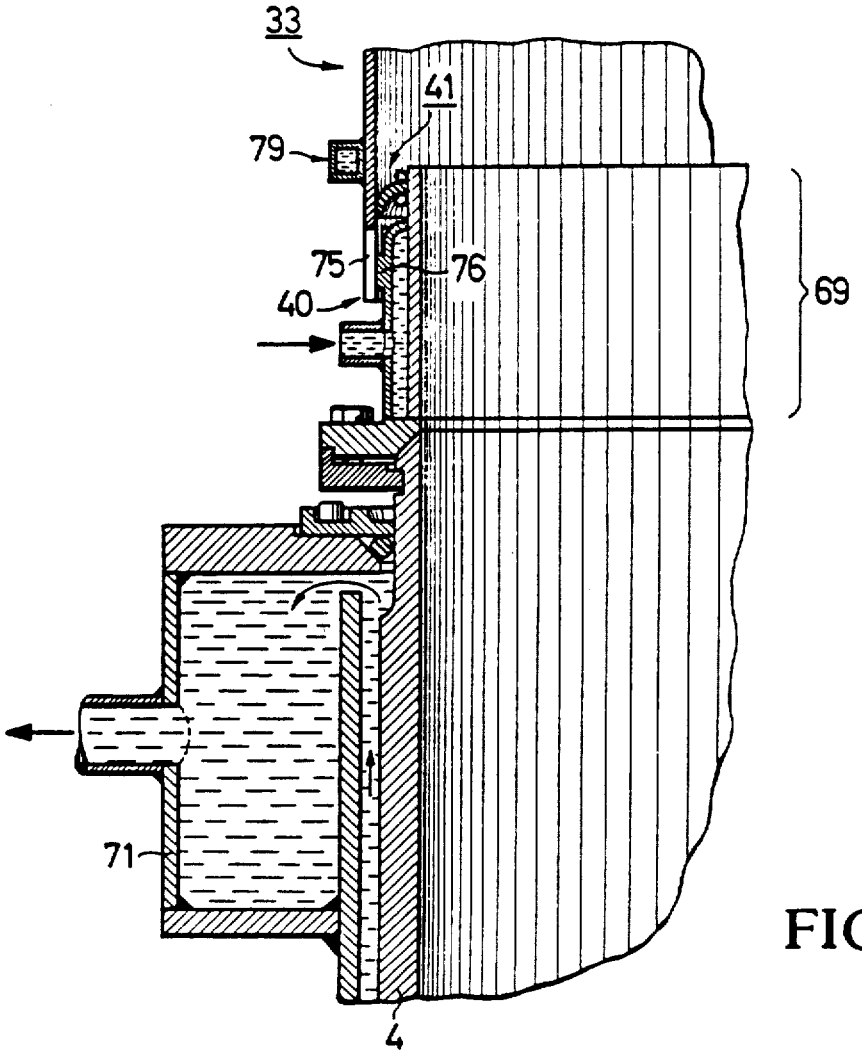
FIG. 8 is an enlarged, partial vertical section through the remelting plant in the area of hood, ingot mold, and ingot mold element in the remelting plant according to FIG. 6.
Figure 6:
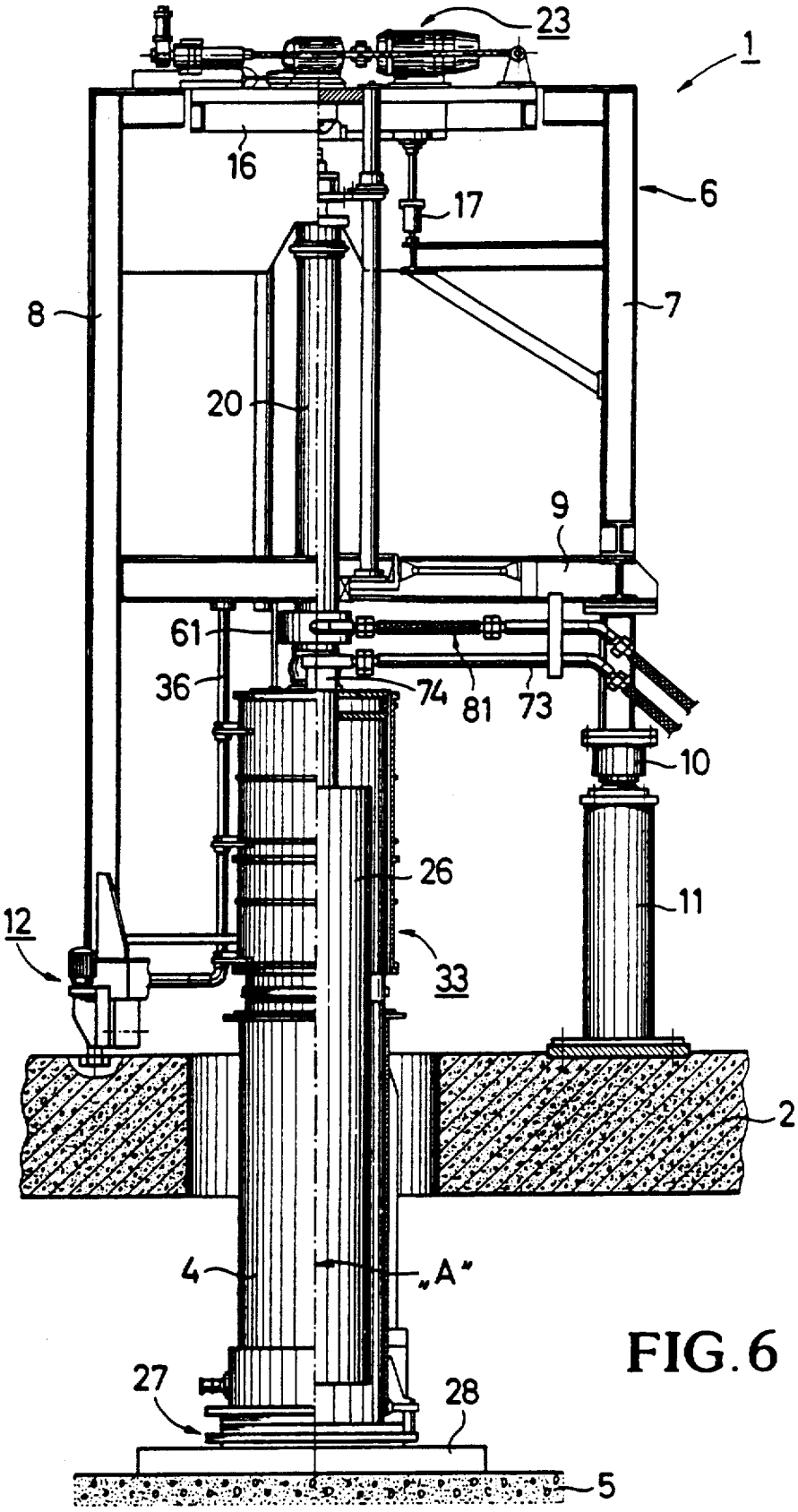
FIG. 6 is a partial vertical section through a complete remelting plant analogous to FIG. 1, however what is different is that omitting the current bars the hood becomes a direct part of the current path.

FIG. 6 is a variant of the remelting plant according to FIG. 1; in this case the busbars 29 and 30 were omitted, which significantly improves the accessibility of the melting area. In the present case the hood 33 serves for an absolute coaxial recirculation of the melting current from the ingot mold 4 to the connecting line 73. For this purpose the hood is provided at its lower edge 40 with a first power supply point 74 and at its upper edge with a second power contact device 75 by means of which the melting current can be transferred to a counter contact device 76 at the ingot mold 4 and the ingot mold top 69 (FIG. 8).

Figure 7:
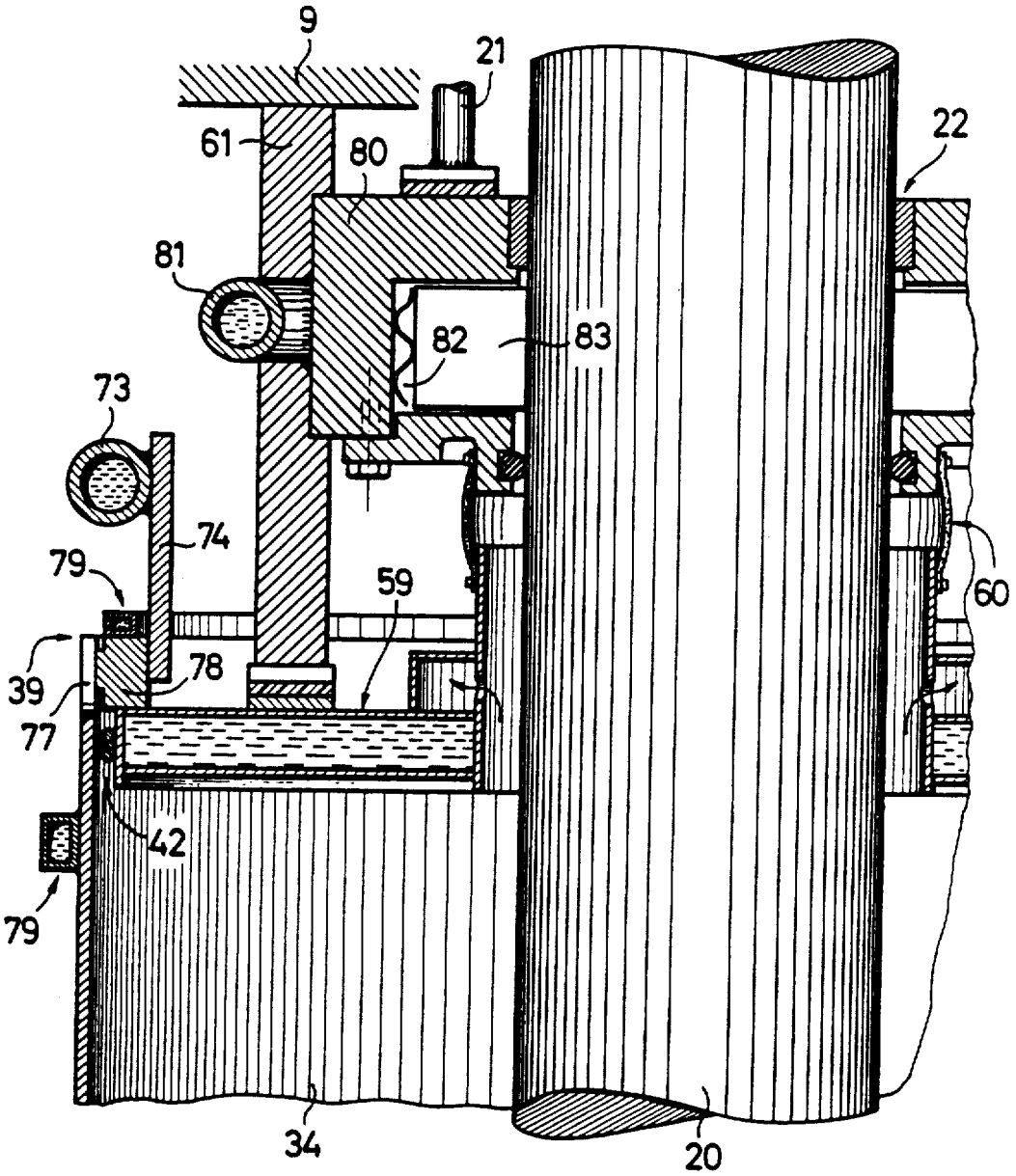
FIG. 7 is an enlarged partial vertical section through the top part of the hood in the area of the front wall and the individual power supplies of the remelting plant according to FIG. 6

According to FIG. 7 the first power supply point 74 is disposed at the annular top 59; strictly speaking, annular-like current contact devices 75 and 77 are disposed between the top wall 59 and the upper edge 39 of the segments 34 and 35. The current contact devices 75 and 77 are formed by strap-like parts at the ends of segments which were created in that the edges of the segments were provided with small slots such that the corresponding ends exhibit spring-elastic properties in order to interact with the counter contact devices 76 and 78. The cooling agent channels 79 serve to remove the joulean heat which is additionally generated in the contact areas.

In the embodiment according to FIGS. 6 to 8 the melting current is supplied to the electrode rod 20 as follows: In the present case the sliding seal is disposed in a housing 80 which is suspended correspondingly to FIG. 1 at the measuring platform via supports 21. In the present case the housing 80 is provided with a connecting line 81 for the melting current and has a hollow space 82 which holds a ring of individual contacts 83. These sliding contacts are, via springs, pressed against the electrode rod 20. The housing 80 is also connected via an elastic intermediate link 60 with the top wall 59; in this case the intermediate link 60 must be made of an electrically insulating material so as to avoid short circuits. From the FIGS. 7 and 8 it can also be gathered that the first and second sealing joints 41 and 42 are formed by the lip and ring seals between the ingot mold top 69 and the hood 33 on the one hand and between the top wall 59 and the hood 33 on the other hand.

In the illustrated embodiments the furnace body 6 can be associated with several ingot molds 4 the axes of which are on one circular path. Since a remelting process can be carried out in only one single ingot mold, respectively, it suffices to use only one hood for the entire remelting plant; together with the furnace body the hood can be transported from ingot mold to ingot mold. Under certain circumstances it can be advantageous in such a case to configure the hood such that it can be adjusted in height by a small extent so as to permit the lower edge 40 of the hood and the sectors to be passed over the individual melting areas even when the sectors are not or not completely extended.

Is it not required to attach the sectors of the hood to an articulated axis, although this is the most simple and most reliable way of mounting. A translational displacement of the sectors is possible without problems and even advantageous when the hood is subdivided in more than two segments. In order to also limit the necessary opening of the segments, a separate or coupled vertical movement of the hood can be provided in addition to the rotational or translational horizontal movement.

We claim:

1. An electroslag remelt plant comprising an ingot mold for forming a block from remolten material of at least one consumable electrode, an electrode rod driven parallel to its axis for the advance of an consumable electrode mounted coaxially thereto, a hood disposed above the ingot mold and comprising two segments which are movable transversely to the axis of the rod, said segments being closable to form a first sealing joint about the ingot mold and a second sealing joint about the electrode rod, said hood having an interior of such cross-section and height that the consumable electrode is, in its most elevated position, below the second sealing joint.

2. Electroslag remelt plant as in claim 1 wherein said segments are semi-cylindrical and are hinged about a vertical articulated axis which is parallel to the axis of the rod, each segment having a lower semicircular edge, an upper semicircular edge, and a pair of vertical edges extending therebetween, said lower semicircular edges forming said first sealing joint, said upper semicircular edges forming said second sealing joint.

3. Electroslag remelting plant as in claim 2 wherein the segments are provided with fastening means opposite the articulated axis.

4. Electroslag remelting plant as in claim 3 wherein the hood is configured to pass a cooling medium therethrough.

5. Electroslag remelting plant as in claim 2 further comprising an annular disc-like top wall having an inside which is sealed to the electrode rod and an outside which is sealable to the hood segments.

6. Electroslag remelting plant as in claim 5 comprising a sliding seal about the rod, said seal being connected gas tight to the annular top wall.

7. Electroslag remelting plant as in claim 5 further comprising a visual monitoring device disposed in the annular top wall.

8. Electroslag remelting plant as in claim 5 further comprising exhaust suction means disposed on the annular top wall.

9. Electroslag remelting plant as in claim 1 further comprising a tubular top attached to the top of the ingot mold, a cooling channel surrounding the tubular top, and a ring seal above the cooling channel.

10. Electroslag remelting plant as in claim 1 further comprising a power supply point on said hood, a current contact device on said hood, and a counter current contact device on said ingot mold, said current contact device transmitting current to said counter current contact device.

11. Electroslag remelting plant as in claim 5 further comprising a first power supply point on said top wall and a current contact device disposed between the top wall and the segments.

12. Electroslag remelting plant as in claim 9 further comprising a current contact device on said hood, and a power supply point on said hood, and a counter current contact device disposed on the tubular top, said current contact device transmitting current to said counter current contact device.

13. Electroslag remelting plant as in claim 10 further comprising cooling means associated with the current contact device and the counter current contact device.

14. Electroslag remelting plant as in claim 1 further comprising means for charging said hood with a gas.

* * * * *